US008511383B2

(12) United States Patent
Stewart et al.

(10) Patent No.: US 8,511,383 B2
(45) Date of Patent: Aug. 20, 2013

(54) BOTTOM HOLE ASSEMBLY

(75) Inventors: Tommy Stewart, Chickasha, OK (US); Michael Brent Bailey, Duncan, OK (US); Andrew John Eis, Duncan, OK (US); Robert Lee Pipkin, Marlow, OK (US); Eric Bivens, Denver, CO (US)

(73) Assignee: Halliburton Energy Services, Inc., Duncan, OK (US)

( * ) Notice: Subject to any disclaimer, the term of this patent is extended or adjusted under 35 U.S.C. 154(b) by 322 days.

(21) Appl. No.: 12/908,192

(22) Filed: Oct. 20, 2010

(65) Prior Publication Data

US 2012/0097396 A1 Apr. 26, 2012

(51) Int. Cl.
*E21B 43/26* (2006.01)
*E21B 33/12* (2006.01)

(52) U.S. Cl.
USPC ..... 166/308.1; 166/128; 166/387

(58) Field of Classification Search
USPC ..... 166/308.1, 128, 178, 387
See application file for complete search history.

(56) References Cited

U.S. PATENT DOCUMENTS

| | | | | |
|---|---|---|---|---|
| 4,552,230 | A * | 11/1985 | Anderson et al. | 175/321 |
| 6,182,766 | B1 | 2/2001 | Rogers et al. | |
| 6,408,943 | B1 | 6/2002 | Schultz et al. | |
| 6,976,507 | B1 | 12/2005 | Webb et al. | |
| 7,405,998 | B2 | 7/2008 | Webb et al. | |
| 7,648,179 | B2 | 1/2010 | Webb et al. | |
| 7,677,302 | B2 | 3/2010 | Ehtesham et al. | |
| 7,832,477 | B2 | 11/2010 | Cavender et al. | |
| 2010/0004890 | A1 | 1/2010 | Tonmukayakul et al. | |
| 2010/0018294 | A1 | 1/2010 | Tonmukayakul et al. | |
| 2010/0133012 | A1 | 6/2010 | Howard et al. | |
| 2010/0252261 | A1 | 10/2010 | Cavender et al. | |
| 2011/0198126 | A1 * | 8/2011 | Swietlik et al. | 175/55 |

* cited by examiner

*Primary Examiner* — William P Neuder
(74) *Attorney, Agent, or Firm* — John W. Wustenberg; Conley Rose, P.C.

(57) ABSTRACT

A bottom hole assembly is provided. The bottom hole assembly comprises an upper component, a lower component and a telescoping assembly disposed between the upper component and the lower component.

16 Claims, 17 Drawing Sheets

BOTTOM HOLE ASSEMBLY

CROSS-REFERENCE TO RELATED APPLICATIONS

Not Applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention generally relates to straddle packer systems used to service a well bore.

BACKGROUND OF THE INVENTION

Hydrocarbons may be produced from well bores drilled from the surface through a variety of producing and non-producing formations. The well bore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

In the servicing of an oil or gas well bore, straddle systems may be used, for example, as a downhole tool for performing fracture testing or fracture diagnostic testing on a formation proximate to the well bore, as well as for fracture treatments, chemical applications or a variety of other services. These assemblies typically include an upper packer or seal, a lower packer or seal and one or more tools, such as a hydraulic fracturing sub, that are situated between the upper and lower packers, are coupled thereto and, thus, "straddle" a gap between the packers. To perform downhole fracture testing, a straddle system is run into the well bore on a work string, the corresponding lower and upper packers are set and the gap in the well bore between the packers is pressurized, for example, by pumping a fluid down the work string and through a fracture port situated in the straddle system.

SUMMARY OF THE INVENTION

In an embodiment, a bottom hole assembly is disclosed. The bottom hole assembly comprises an upper component, a lower component and a telescoping assembly disposed between the upper component and the lower component.

In a further embodiment, a bottom hole assembly is disclosed. The bottom hole assembly comprises an upper component, a lower component and a telescoping assembly disposed between the upper component and the lower component. The telescoping assembly comprises at least two telescoping members and a force-generating element adapted to apply forces to the telescoping members.

In a further embodiment, a method for servicing a well bore is disclosed. The method comprises running into the well bore a bottom hole assembly comprising an upper component, a lower component and a telescoping assembly disposed between the upper component and the lower component. The method further comprises fixing an upper portion of the upper component and a lower portion of the lower component in position with respect to the well bore. The method further comprises sealing an annulus bounded by the well bore, the telescoping assembly, a sealing portion of the upper component and a sealing portion of the lower component. The method further comprises pressurizing the annulus.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION OF THE EMBODIMENTS

It should be understood at the outset that although illustrative implementations of one or more embodiments are illustrated below, the disclosed assemblies and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Unless otherwise specified, any use of the term "couple" describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

To perform certain types of servicing operations on an oil or gas well bore (e.g., fracture testing), a straddle system may be run into the well bore, lower and upper packers of the straddle system are set and a gap in the well bore between the packers is pressurized. In order to set the packers and keep the packers set prior to and during pressurization of the gap, a sufficient set weight may need to be applied to the packers from above, via a conveyance to which the straddle system is coupled. When the conveyance used to run the straddle system into the well bore is jointed pipe, a high set weight on the packers can usually be attained due to the high stiffness of jointed pipe. However, in applications where a high set weight cannot always be attained, for instance, when coiled tubing is used as the conveyance, or in the case of extended lateral well bores, the upper and/or lower packer may not achieve a positive seal or undesirably lose its seal during gap pressurization.

Figure 1:
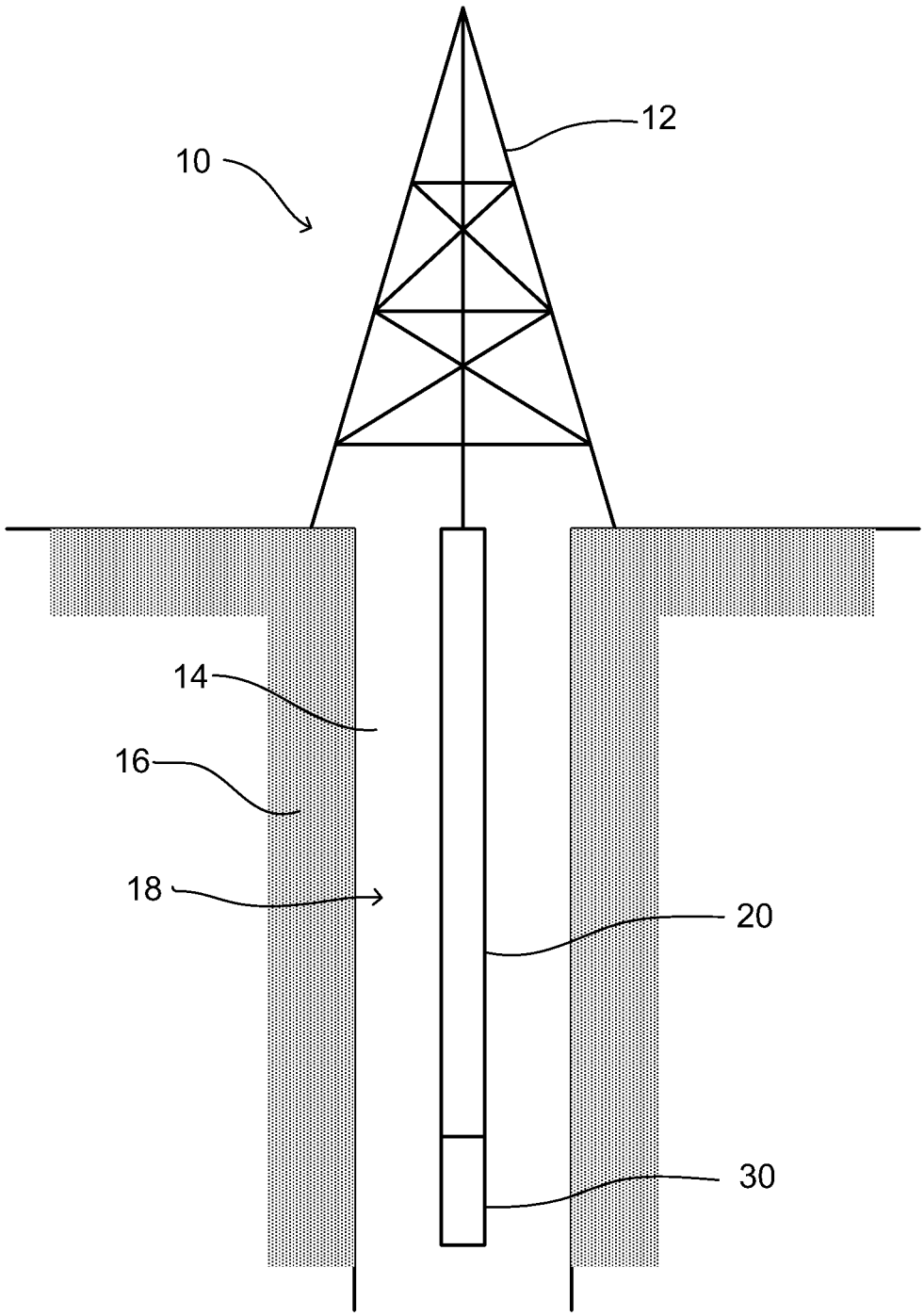
FIG. 1 is a schematic illustration of a well bore, a method of conveyance, and a bottom hole assembly according to an embodiment of the disclosure.

Turning now to FIG. 1, a wellbore servicing system 10 is described. The system 10 comprises a servicing rig 12 that extends over and around a well bore 14 that penetrates a subterranean formation 16 for the purpose of recovering hydrocarbons, storing hydrocarbons, disposing of carbon dioxide, or the like. The well bore 14 may be drilled into the subterranean formation 16 using any suitable drilling technique. While shown as extending vertically from the surface in FIG. 1, in some embodiments the well bore 14 may be deviated, horizontal, and/or curved over at least some portions of the well bore 14. The well bore 14 may be cased, open hole, contain tubing, and may generally comprise a hole in the ground having a variety of shapes and/or geometries as is known to those of skill in the art.

The servicing rig 12 may be one of a drilling rig, a completion rig, a workover rig, a servicing rig, or other mast structure and supports a work string 18 in the well bore 14, but in other embodiments a different structure may support the work string 18, for example an injector head of a coiled tubing rigup. In an embodiment, the servicing rig 12 may comprise a derrick with a rig floor through which the workstring 18 extends downward from the servicing rig 12 into the well bore 14. In some embodiments, such as in an off-shore location, the servicing rig 12 may be supported by piers extending downwards to a seabed. Alternatively, in some embodiments, the servicing rig 12 may be supported by columns sitting on hulls and/or pontoons that are ballasted below the water surface, which may be referred to as a semi-submersible platform or rig. In an off-shore location, a casing may extend from the servicing rig 12 to exclude sea water and contain drilling fluid returns. It is understood that other mechanical mechanisms, not shown, may control the run-in and withdrawal of the work string 18 in the well bore 14, for example a draw works coupled to a hoisting apparatus, a slickline unit or a wireline unit including a winching apparatus, another servicing vehicle, a coiled tubing unit, and/or other apparatus.

In an embodiment, the work string 18 may comprise a conveyance 20, a bottom hole assembly 30, such as a straddle system (as described in more detail herein), and other tools and/or subassemblies located above or below the bottom hole assembly 30. The conveyance 20 may comprise any of a string of jointed pipes, a slickline, a coiled tubing, a wireline, and other conveyances for the bottom hole assembly 30, which have annular pressure capability.

Figure 2:
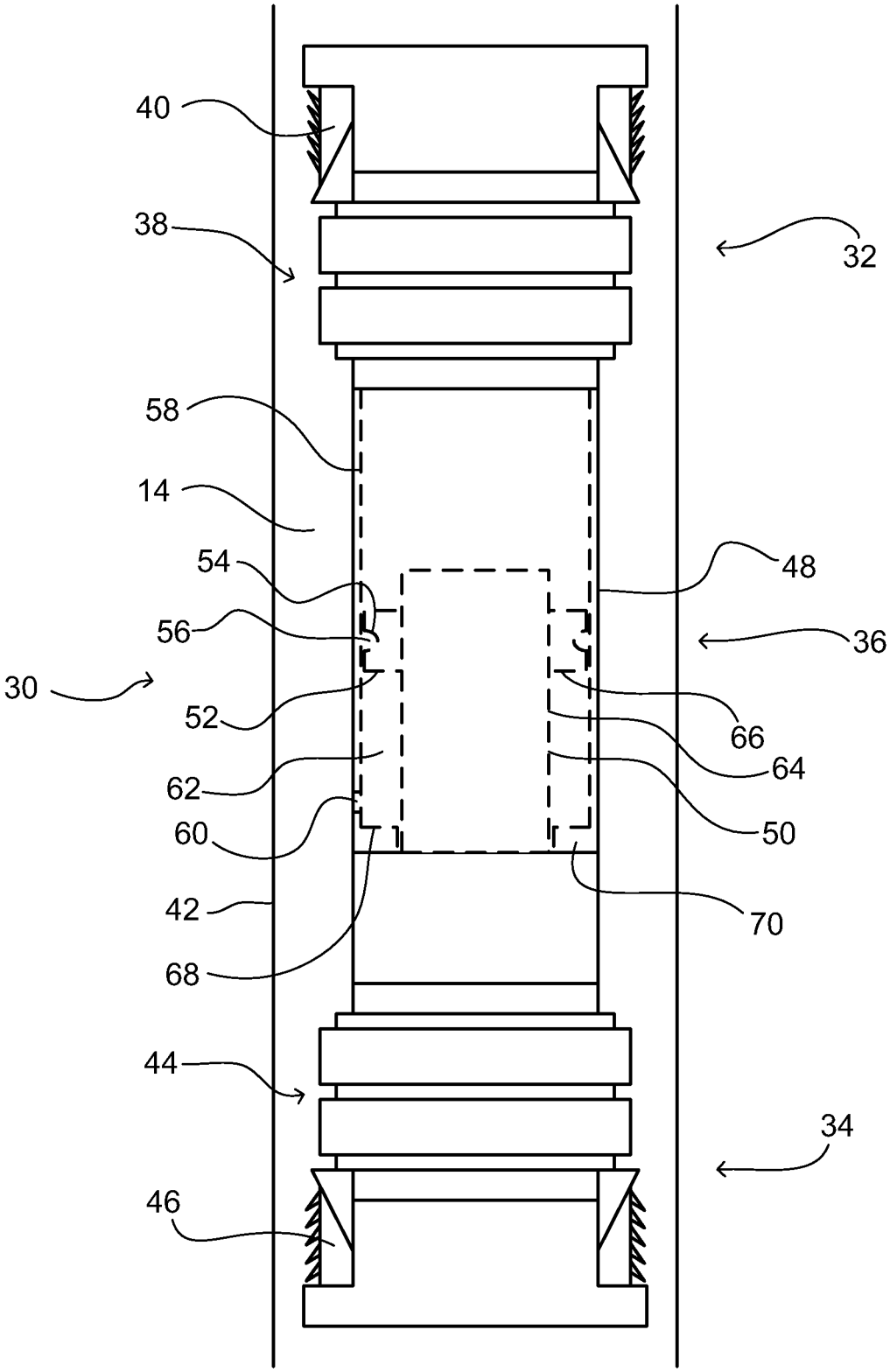
FIG. 2 is a schematic illustration of a bottom hole assembly according to an embodiment of the disclosure.

Turning now to FIG. 2, an embodiment of the bottom hole assembly 30 is described. The bottom hole assembly 30 is shown suspended in the well bore 14. The bottom hole assembly 30 may be a straddle system, for example, a straddle system used for fracture testing and/or fracture diagnostic testing on the subterranean formation 16, and may include an upper component 32, a lower component 34 and a telescoping assembly 36 situated between the upper component 32 and the lower component 34. In various embodiments, an internal fluid passage and a hydraulic fracturing port may be included in the bottom hole assembly 30 of FIGS. 2 to 14. For example, in the case of a straddle system used for fracture testing or fracture diagnostic testing, an internal fluid passage and hydraulic fracturing port are present in such a straddle system. Furthermore, FIG. 15 includes a hydraulic fracture testing subassembly 76, which includes ports 74 and may be used for fracture testing or fracture diagnostic testing, and such subassembly 76 may be employed in any of the embodiments shown in FIGS. 2 to 14. Continuing a discussion of FIG. 2, the upper component 32 may include a sealing element 38 and slips 40 for fixing the upper component 32 in position with respect to a wall 42 of the well bore 14. Similarly, the lower component 34 may include a sealing element 44 and slips 46 for fixing the lower component 34 in position with respect to wall 42 of the well bore 14. Sealing elements 38 and 44 may be made of rubber or any other elastomer suitable for forming a seal with the wall 42 of the well bore 14 or a casing situated between the wall 42 and the sealing elements 38, 44. The elastomer may include any suitable elastomeric material or rubber, for example butyl rubber, polybutadiene, styrene-butadiene rubber, nitrile rubber, ethylene propylene rubber, ethylene propylene diene rubber, and the like. In an embodiment, the elastomer may be a thermoplastic elastomer (TPE). Without limitation, examples of monomers suitable for use in forming TPEs include dienes such as butadiene, isoprene and hexadiene, and/or monoolefins such as ethylene, butenes, and 1-hexene. In an embodiment, the TPE includes polymers comprising aromatic hydrocarbon monomers and aliphatic dienes. Examples of suitable aromatic hydrocarbon monomers include without limitation styrene, alpha-methyl styrene, and vinyltoluene. In an embodiment, the TPE is a crosslinked or partially crosslinked material. The elastomer may have any particle size compatible with the needs of the process. For example, the particle size may be selected by one of ordinary skill in the art with the benefits of this disclosure to allow for easy passage through standard wellbore servicing devices such as for example pumping or downhole equipment. In an embodiment, the elastomer may have a median particle size, also termed d50, of greater than about 500 microns, alternatively of greater than about 550 microns, and a particle size distribution wherein about 90% of the particles pass through a 30 mesh sieve US series.

In further regard to FIG. 2, the telescoping assembly 36 may include a housing 48 and an inner mandrel 50 movably disposed in the housing 48. The housing 48 and inner mandrel 50 may be made of steel or other alloys designed to withstand a corrosive $H_2S$ environment, for example, HT95 steel. Alternatively, other steels or composite materials or non-metallic materials may be used. The inner mandrel 50 may include a collar 52 in which a groove 54 is formed. In some embodiments, an O-ring 56 may be placed in the groove 54 in order to form a seal between the collar 52 and an inner wall 58 of the housing 48. In addition, an aperture 60 may be formed in the housing. The aperture 60 may allow a pressure in a chamber 62 bounded by an outer circumferential surface 64 of the inner mandrel 50, a lower face 66 of the collar 52, the inner wall 58 of the housing 48, and an annular inner surface 68 of a flange 70 to be approximately equal to a pressure in a region of the well bore 14 proximate to the aperture 60.

In operation, the bottom hole assembly 30 may be run into the well bore 14 to a section of the well bore 14 where, for example, hydraulic fracture testing is to be conducted. Then, as shown schematically in FIG. 3, the slips 46 of the lower component 34 may be actuated so as to contact the wall 42 or a casing cemented to the wall, and approximately simultaneously, a force or set weight may be applied to the bottom hole assembly 30 via the conveyance 20. The application of the set weight may cause the slips 46 to grip the wall 42 and fix the lower component 34 in position with respect to wall 42. In addition, the application of the set weight may cause the sealing element 44 to expand outwards and contact and form a seal with the wall 42 of well bore 14. As the lower component 34 is fixed in position, the set weight applied via conveyance 20 may cause the sealing element 38 of the upper component 32 to expand outwards and form a seal with wall 42. The slips 40 of the upper component 32 may then be actuated so as to contact and grip the wall 42 and fix the upper component 32 in position with respect to the wall 42. An annulus or straddle area 72 is defined by the sealing elements 38, 44, the wall 42 of the well bore 14, and the telescoping assembly 36. The annulus 72 is pressurized by pumping $N_2$ or another suitable fluid or gas into the annulus 72 via, for example, ports 74 situated in a hydraulic fracture testing sub-assembly 76 shown in FIG. 15.

Figure 4:
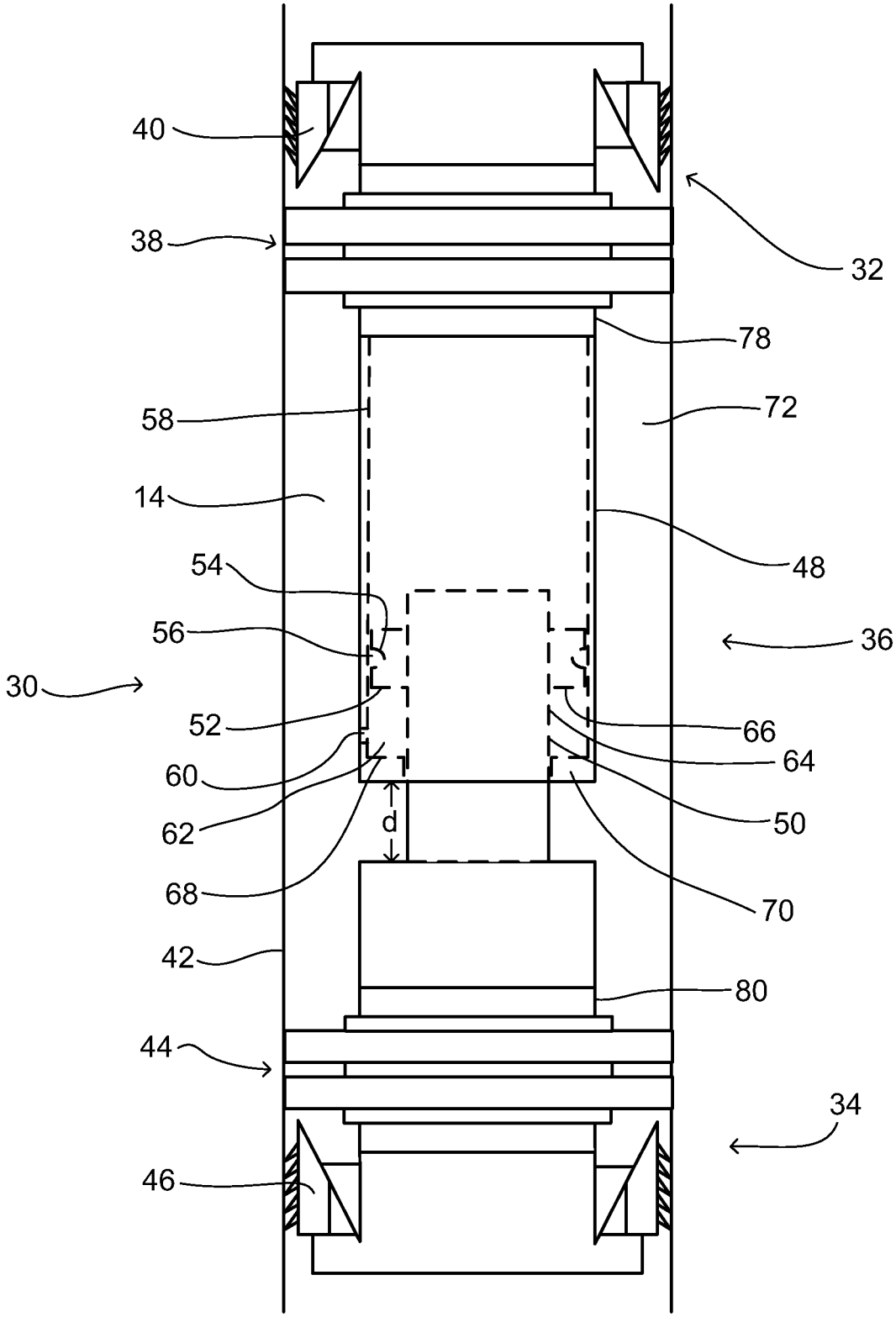
FIG. 4 is a further illustration of the bottom hole assembly of FIG. 2.

Referring now to FIG. 4, fluid pumped into the annulus 72 may increase the pressure in the annulus 72 from about 0 to about 15,000 psi or to a pressure limit of the straddle packer system. Since the sealing elements 38 and 44 are deformable and the slips 40 and 46 fix upper and lower components 32 and 34, respectively, in position with respect to wall 42, the pressure may cause, for example, the sealing element 44 to compress further in the direction of slip 46. In so doing, sealing element 44 exerts a downwards force on its upper shoe 80 and, consequently, inner mandrel 50. Since inner mandrel 50 is capable of telescoping inside of housing 48, the force exerted by sealing element 44 on inner mandrel 50 may cause the inner mandrel 50 to move a distance d relative to the housing 48. In addition, a ratchet system may be incorporated in the upper component to hold the lower shoe 78 in place with respect to the sealing element 38.

In a bottom hole assembly or straddle system, in which sub-assemblies situated between sealing elements are rigidly attached to one another and the sealing elements, the compressive forces exerted on the sealing elements due to annulus pressurization could cause one or more of the sealing elements to be pulled off their respective shoes, thereby increasing the risk of seal failure and subsequent loss of pressure in the annulus. Therefore, the telescoping assembly 36 may allow the sealing elements 38, 44 to compress without significant resistance and reliably withstand the pressure of the fluid pumped into annulus 72.

Figure 5:
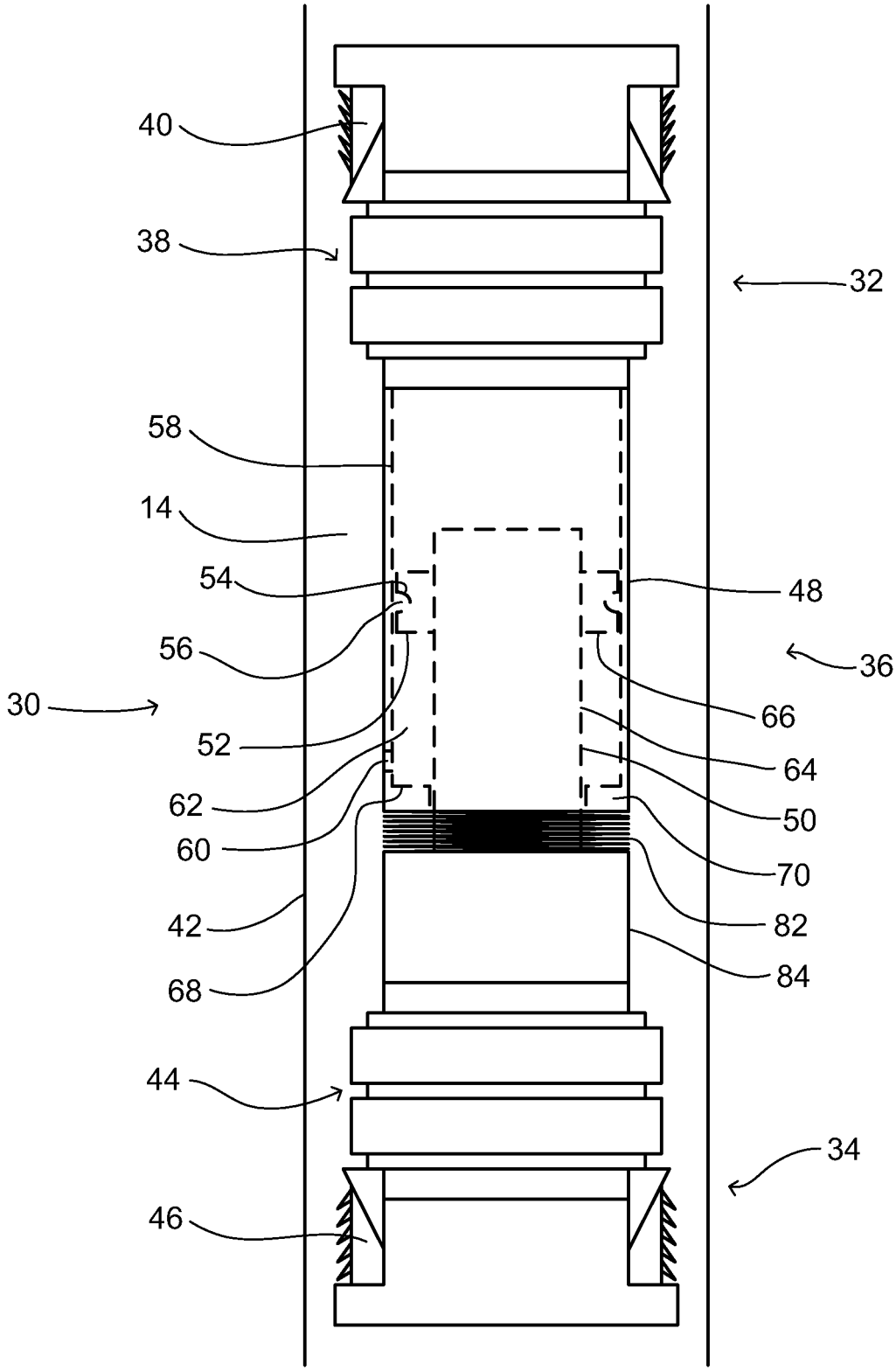
FIG. 5 is a schematic illustration of a bottom hole assembly according to an embodiment of the disclosure.
Figure 6:
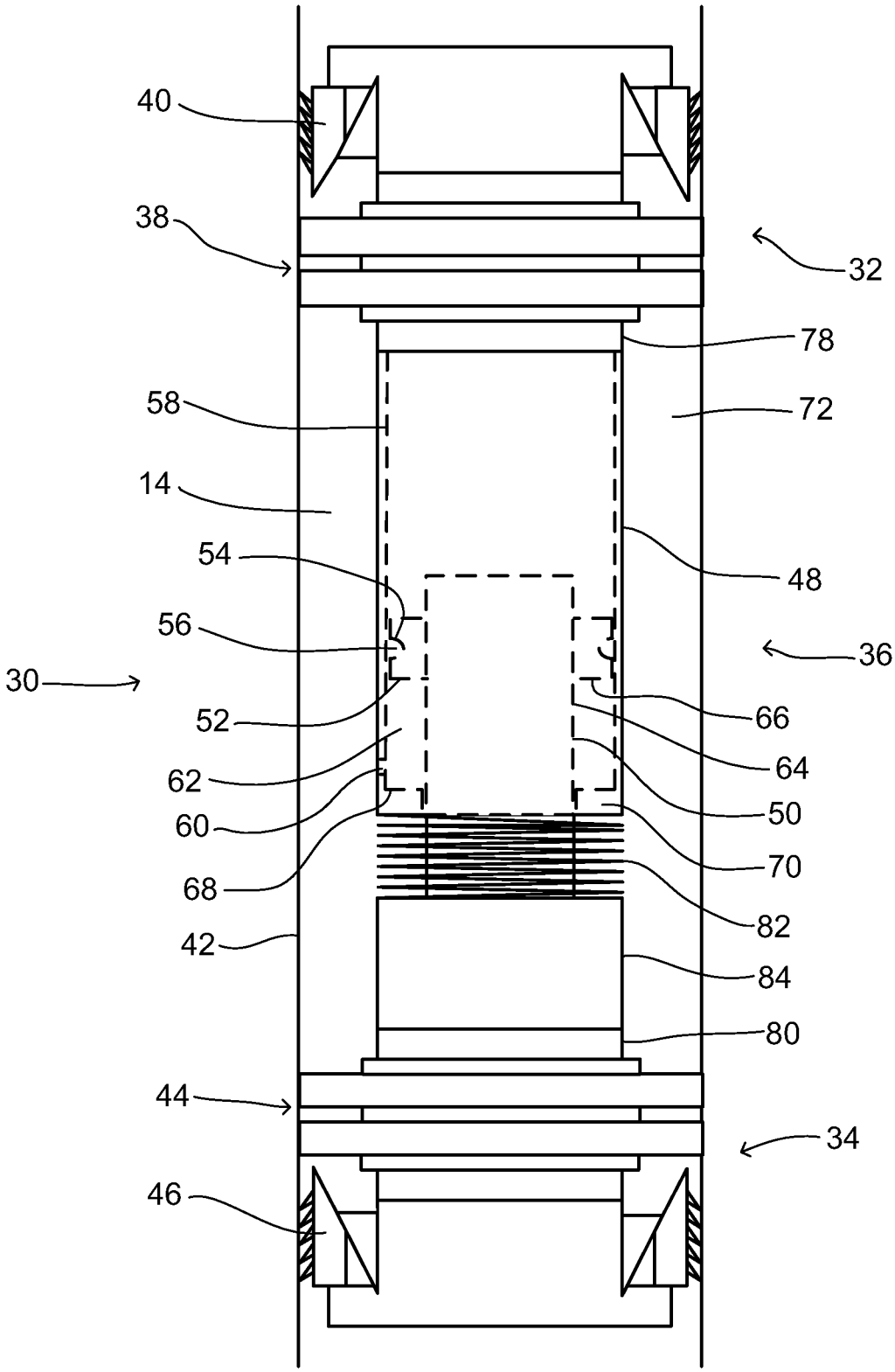
FIG. 6 is a further illustration of the bottom hole assembly of FIG. 5.

Turning now to FIG. 5, an embodiment of a bottom hole assembly 30 is illustrated in which a force-generating element, e.g., a spring 82, is positioned on the inner mandrel 50 and compressed between a base 84 of the inner mandrel 50 and the flange 70 of the housing 48. In operation, the slips 40 and 46 may be actuated and the sealing elements 38 and 44 may be deployed and expanded outwardly in the manner described for the embodiment of the bottom hole assembly 30 illustrated in FIG. 2 and FIG. 3. However, when the annulus 72 is pressurized, as shown in FIG. 6, the spring 82 maintains energized mechanical compressive forces on the inner mandrel 50 and the housing 48, which are transmitted to the upper shoe 80 of sealing element 44 and the lower shoe 78 of sealing element 38. Thus, the compressive forces exerted by the spring may allow the shoes 78 and 80 to remain engaged with the sealing elements 38 and 44 when annulus 72 is pressurized.

Figure 7:
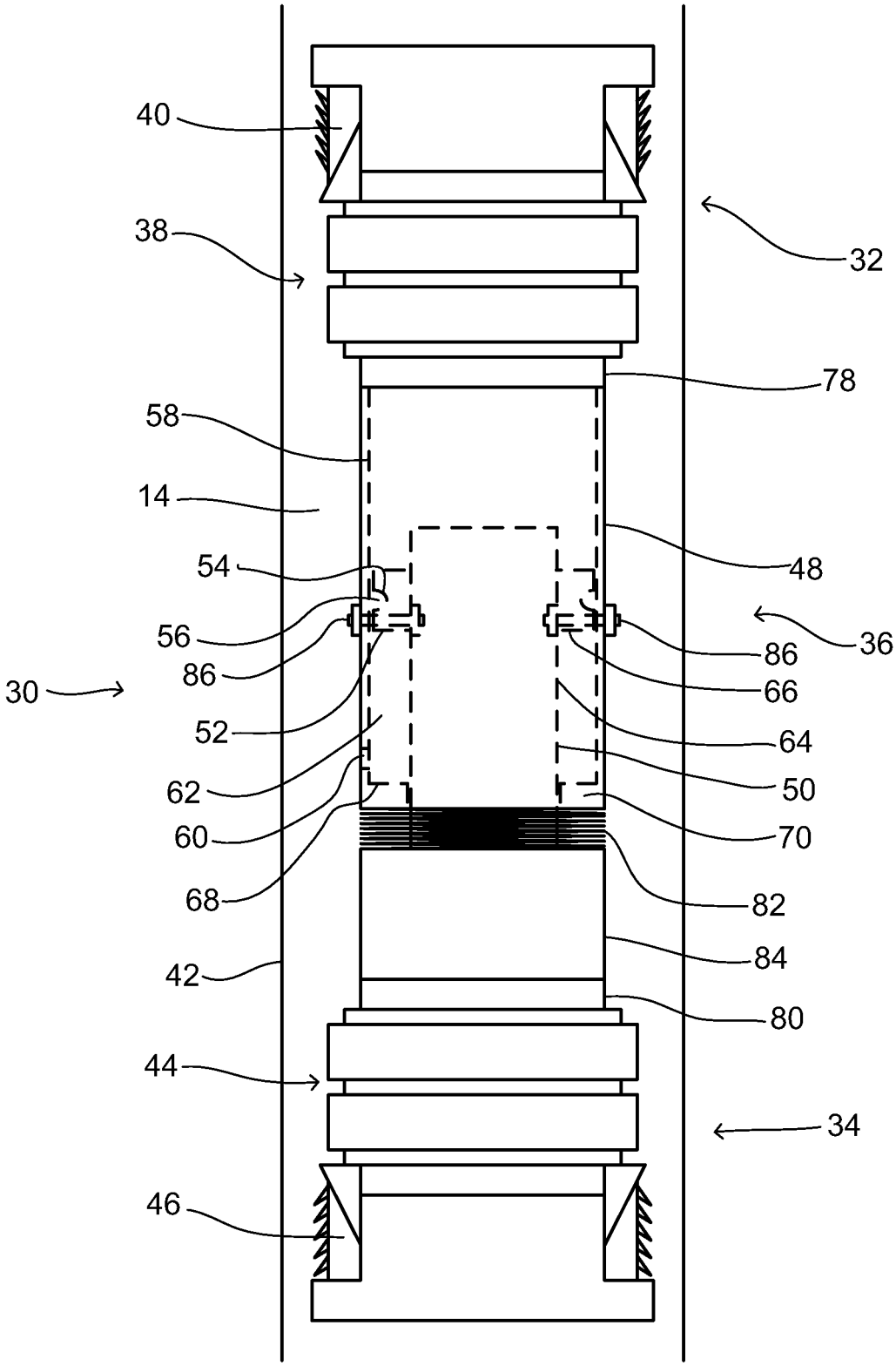
FIG. 7 is a schematic illustration of a bottom hole assembly according to an embodiment of the disclosure.
Figure 8:
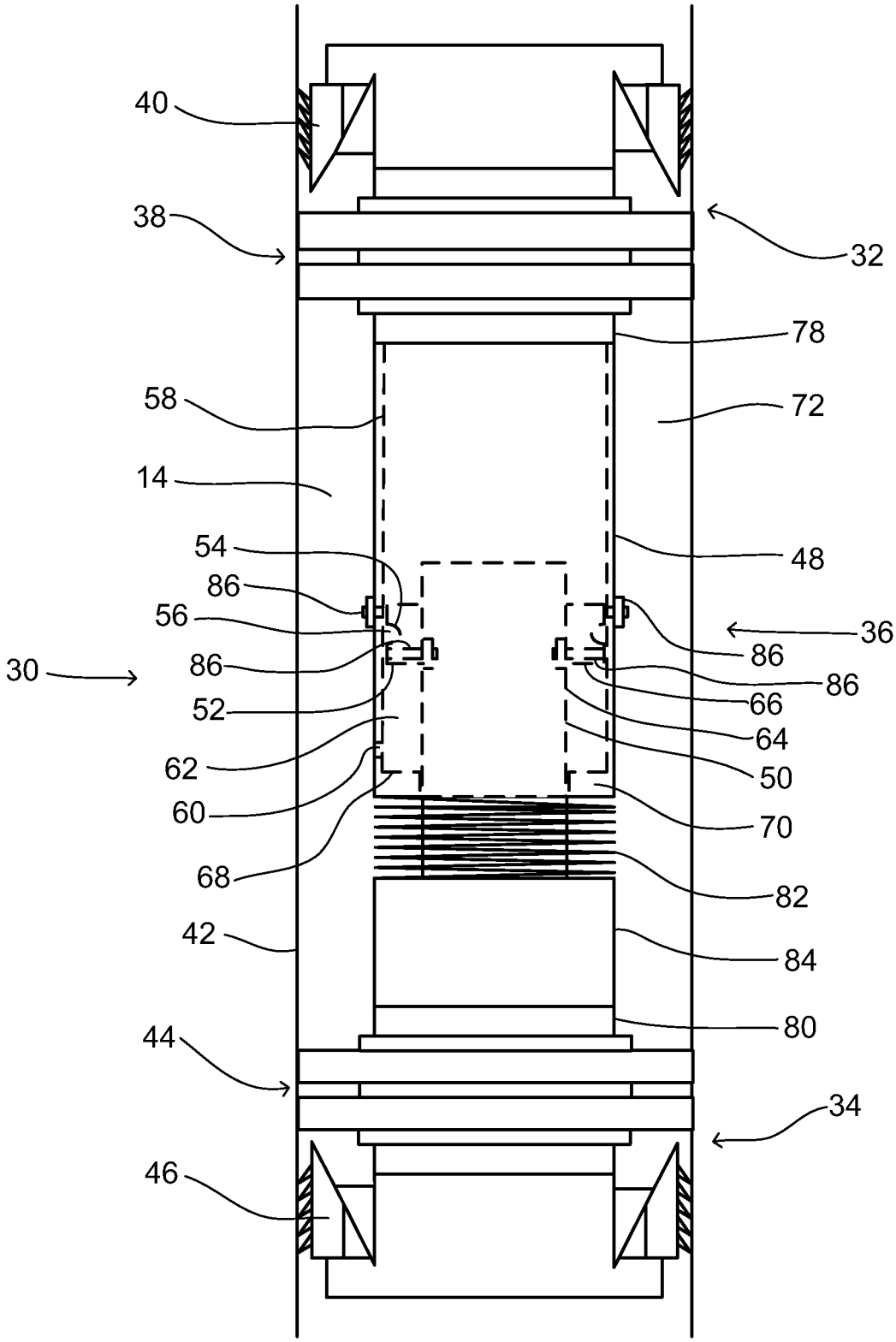
FIG. 8 is a further illustration of the bottom hole assembly of FIG. 7.

FIG. 7 illustrates a bottom hole assembly according to a further embodiment of the disclosure. As in the case of the embodiment illustrated in FIG. 5 and FIG. 6, a spring 82 is compressed between the flange 70 of housing 48 and the base 84 of inner mandrel 50. However, the bottom hole assembly of FIG. 7 also includes shear pins 86, which may rigidly and detachably connect the inner mandrel 50 to the housing 48. In operation, the slips 40 and 46 may be actuated and the sealing elements 38 and 44 may be deployed and expanded outwardly in the manner described for the embodiment of the bottom hole assembly 30 illustrated in FIG. 2 and FIG. 3. When fluid is subsequently pumped into the annulus 72, the sealing elements 38 and 44 may begin to compress and apply forces to housing 48 and inner mandrel 50, respectively. However, unlike the embodiment illustrated in FIG. 5 and FIG. 6, the inner mandrel 50 and housing 48 are initially unable to move relative to one another due to the presence of the shear pins 86. As pressure in the annulus 72 increases, and when the combined forces applied to the housing 48 and inner mandrel 50 by the sealing elements 38 and 44 and the compressed spring 82 are such that the combined shear strength of the shear pins 86 is exceeded, the shear pins 86 may fail. As shown in FIG. 8, this failure of the shear pins 86 may allow the spring 82 to move the housing 48 and inner mandrel 50 relative to one another and to apply impulse forces to the portions of the sealing elements 38 and 44 directly above and below lower shoe 78 and upper shoe 80, respectively. The application of impulse forces to the sealing elements 38 and 44 over a short period of time may allow the sealing elements 38 and 44 to compress and retain a seal with the wall 42 in an effective manner.

Figure 9:
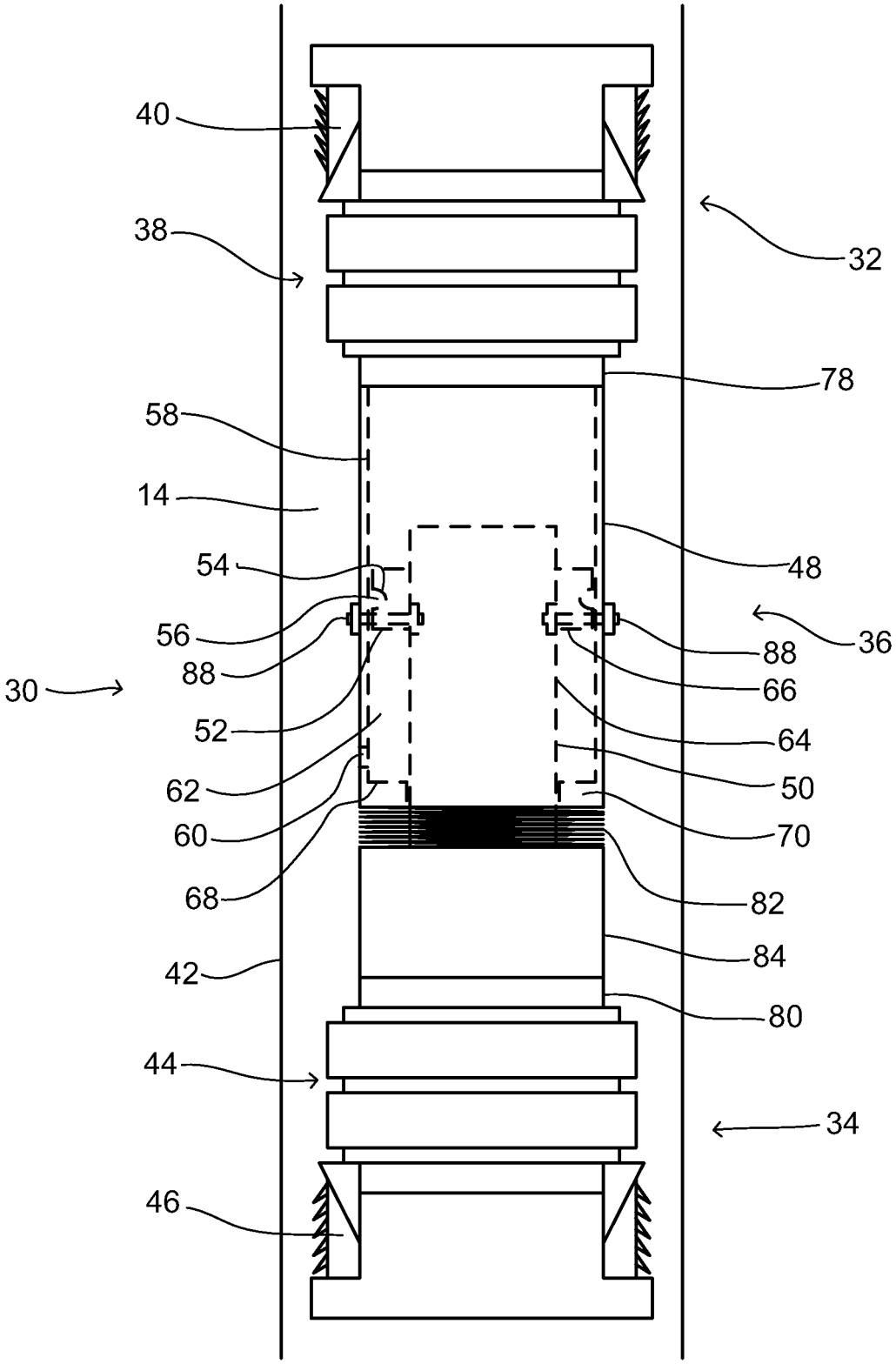
FIG. 9 is a schematic illustration of a bottom hole assembly according to an embodiment of the disclosure.
Figure 10:
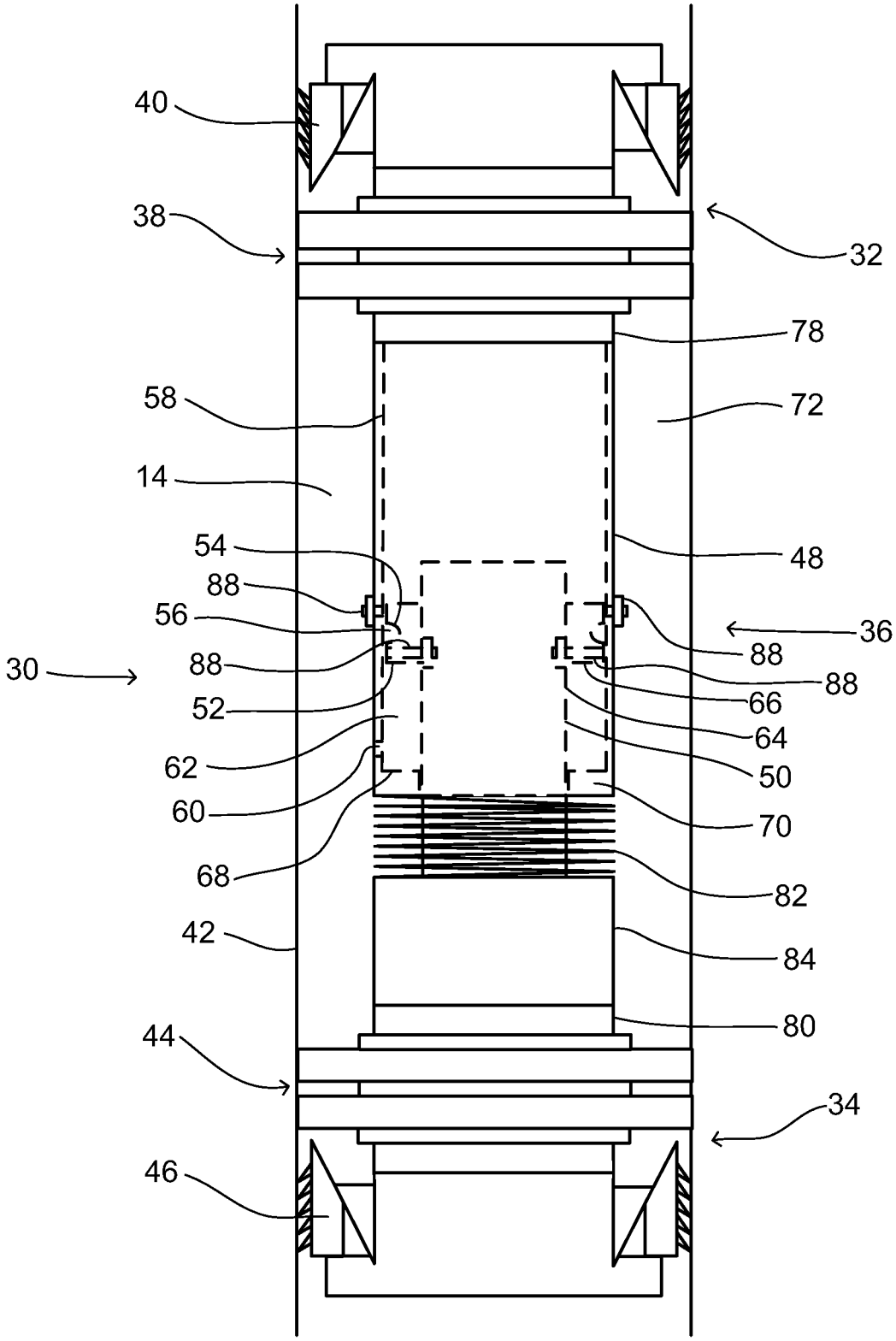
FIG. 10 is a further illustration of the bottom hole assembly of FIG. 9.

FIG. 9 illustrates a bottom hole assembly according to a further embodiment of the disclosure. As in the case of the embodiment illustrated in FIG. 7 and FIG. 8, a spring 82 is compressed between the flange 70 of housing 48 and the base 84 of inner mandrel 50, and the housing 48 and inner mandrel 50 are initially rigidly connected to each other. However, in the present embodiment of bottom hole assembly 30, housing 48 and inner mandrel 50 may be connected to each other by pyrotechnic actuators or electronic-activated releasing mechanisms 88 in lieu of or in addition to shear pins 86. In operation, after the slips 40 and 46 have been actuated and the sealing elements 38 and 44 have been deployed and expanded against the wall 42 of well bore 14, the annulus 72 thus formed may be pressurized. As pressurizing fluid is pumped into the annulus 72 and the sealing elements 38 and 44 start to compress and exert forces on housing 48 and inner mandrel 50, as illustrated in FIG. 10, the pyrotechnic actuators 88 may be severed responsive to an operator control input or to downhole parameters, thereby allowing a selected impulse force to be exerted on the sealing elements 38 and 44.

Figure 11:
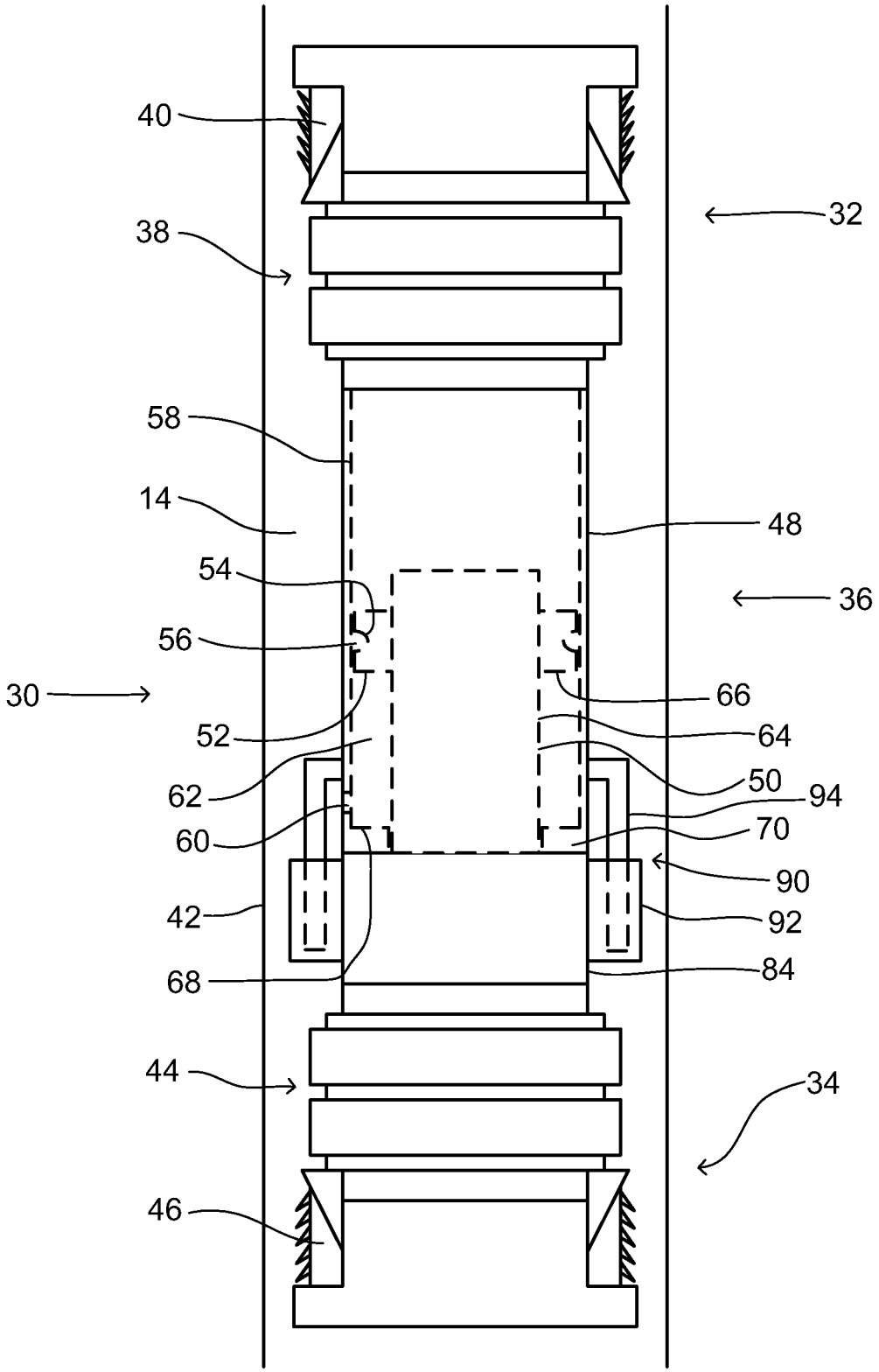
FIG. 11 is a schematic illustration of a bottom hole assembly according to an embodiment of the disclosure.
Figure 12:
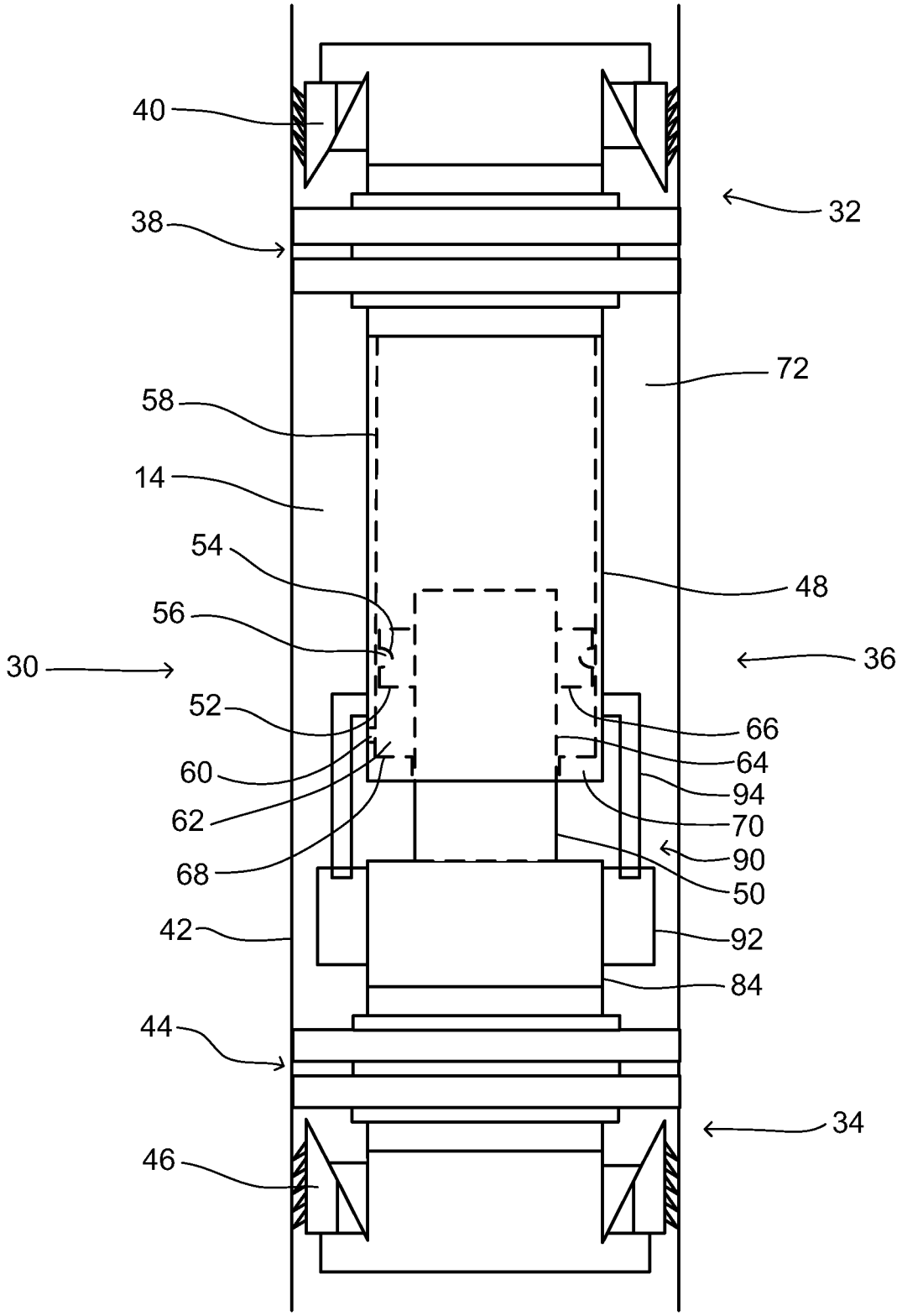
FIG. 12 is a further illustration of the bottom hole assembly of FIG. 11.

Illustrated in FIG. 11 and FIG. 12 is a further embodiment of a bottom hole assembly 30, in which a hydraulic cylinder 90 may be used as a force-generating element to force apart housing 48 and inner mandrel 50. The hydraulic cylinder 90 may include a fluid reservoir 92 that contains a suitable hydraulic fluid, a cylinder 94 that is partly submerged in the reservoir 92 and partly protrudes from the reservoir 92, and hydraulic inlet and outlet lines that are connected to the reservoir but are not shown for the sake of simplicity. The reservoir 92 is shown as coupled to the base 84 of the inner mandrel 50, and the cylinder 94 is shown as coupled to the housing 48, but the reservoir 92 may instead be coupled to the housing 48 and the cylinder 94 coupled to the base 84 of the inner mandrel 50. In addition, the cylinder 94 is shown as a hollow, circumferentially continuous cylinder. However, the cylinder 94 may also include a plurality of individual members, which are coupled to the housing 48, partially submerged in the reservoir 92 and approximately evenly spaced about a circumference of the housing 48.

Figure 3:
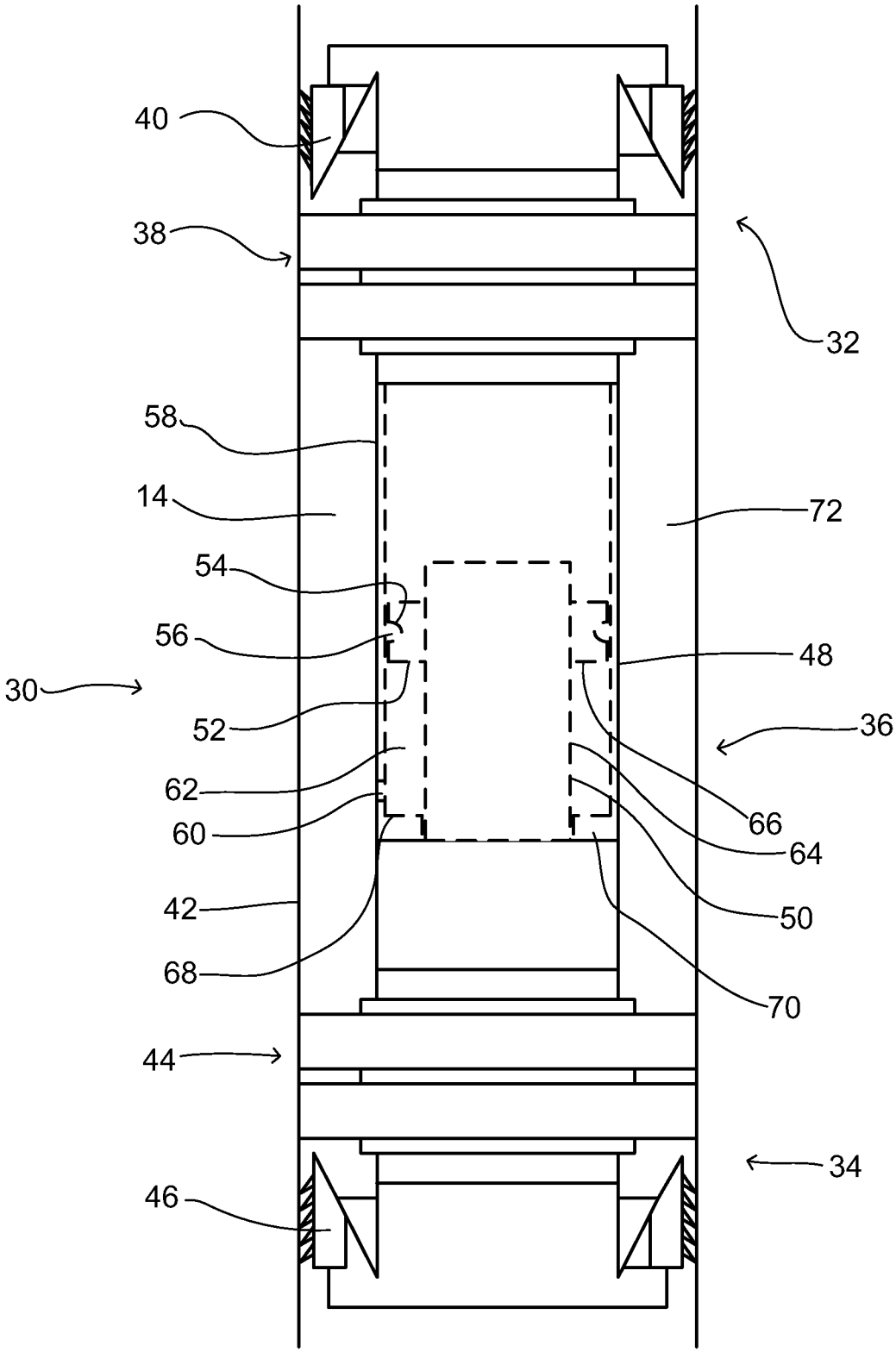
FIG. 3 is a further illustration of the bottom hole assembly of FIG. 2.

In operation, the slips 40 and 46 may be actuated and the sealing elements 38 and 44 may be deployed and expanded outwardly in the manner described for the embodiment of the bottom hole assembly 30 illustrated in FIG. 2 and FIG. 3. When fluid is subsequently pumped into the annulus 72, the sealing elements 38 and 44 may begin to compress and apply forces to housing 48 and inner mandrel 50, respectively. Since the inner mandrel 50 may telescope inside of housing 48 without having to overcome large friction forces, the forces applied by the sealing elements 38 and 44 to the housing 48 and inner mandrel 50 may cause the latter to move apart from one another. In addition, before or while pressurizing fluid is pumped into the annulus 72, hydraulic fluid may be pumped into reservoir 92 via the hydraulic lines. Optionally, a rupture disk may be situated in the hydraulic inlet line or at an entrance to the reservoir 92, so that the hydraulic fluid is only able to flow into the reservoir 92 after reaching a certain pressure and rupturing the rupture disk. Additionally, or alternatively, shear pins and/or explosive bolts as described previously may be used in combination with the hydraulic embodiment shown in FIG. 11 and FIG. 12, thereby providing a means for applying an impulse force, if so desired. In such embodiments, the hydraulic fluid forces cylinder 94 upwards with respect to reservoir 92, thereby applying auxiliary forces to a central portion of sealing elements 38 and 44 via housing 48 and inner mandrel 50. The telescoping action of housing 48 and inner mandrel 50, together with the auxiliary forces applied to both by the hydraulic cylinder 90, may allow the sealing elements 38 and 44 to compress evenly and retain a seal with the wall 42 of the well bore 14 as annulus 72 is pressurized.

Figure 13:
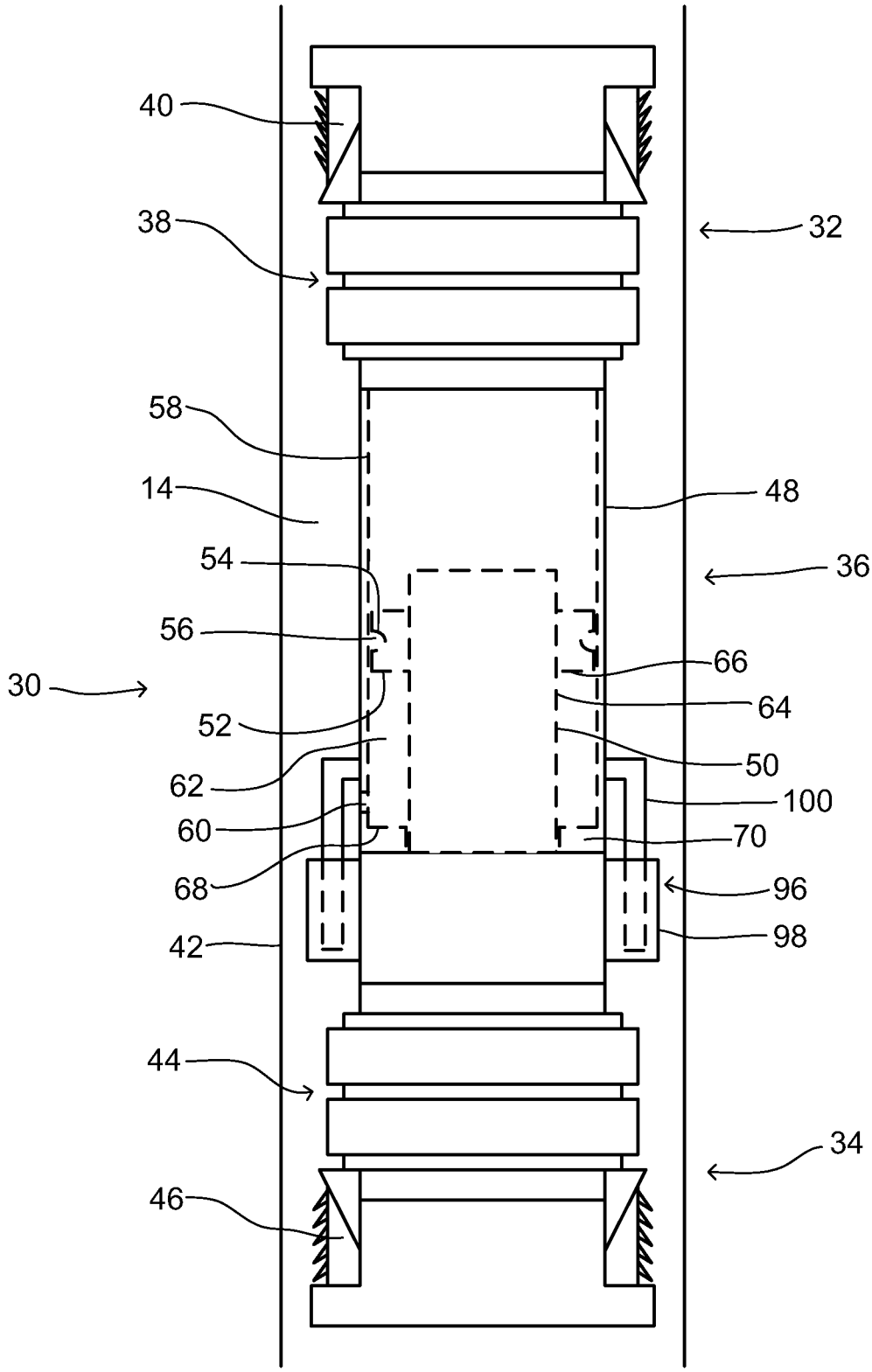
FIG. 13 is a schematic illustration of a bottom hole assembly according to an embodiment of the disclosure.
Figure 14:
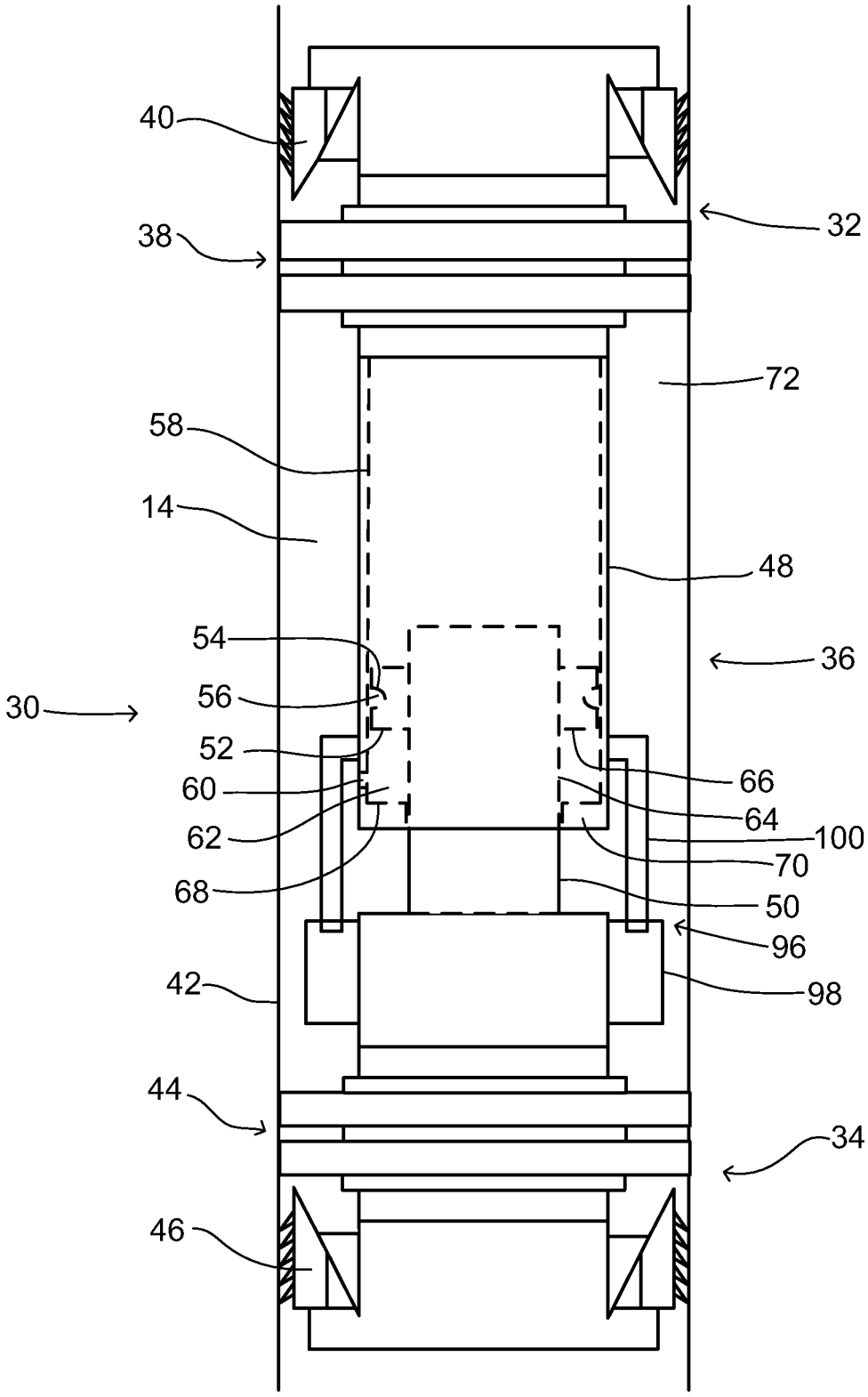
FIG. 14 is a further illustration of the bottom hole assembly of FIG. 13.

Turning now to FIG. 13 and FIG. 14, illustrated is a further embodiment of a bottom hole assembly 30, in which a pneumatic cylinder 96 may be used as a force-generating element to force apart housing 48 and inner mandrel 50. The pneumatic cylinder 96 may include a pneumatic reservoir 98 that contains a compressed gas and may be coupled to the base 84 of inner mandrel 50, a cylinder 100 that partially extends into the reservoir 98 and may be coupled to housing 48, and inlet and outlet lines that are coupled to the reservoir 98 but not shown for the sake of simplicity.

In operation, the present embodiment of the bottom hole assembly 30 functions in a manner analogous to the embodiment of the bottom hole assembly 30 illustrated in FIG. 11 and FIG. 12. The slips 40 and 46 may be actuated and the sealing elements 38 and 44 may be deployed and expanded outwardly in the manner described for the embodiment of the bottom hole assembly 30 illustrated in FIG. 2 and FIG. 3. When the annulus 72 is pressurized, fluid pumped into the annulus 72 exerts compressive forces on sealing elements 38 and 44, which, in turn, exert forces on housing 48 and inner mandrel 50 and cause the latter to move relative to each other. In addition, before or while the annulus 72 is pressurized, compressed gas may be pumped into pneumatic reservoir 98. The compressed gas may exert forces on cylinder 100, which are transmitted to a center portion of sealing elements 38 and 44 via housing 48 and inner mandrel 50. Thus, the telescoping action of housing 48 and inner mandrel 50, together with the compressive forces applied to the sealing elements 38 and 44 by the pneumatic cylinder 96, may allow the sealing elements 38 and 44 to compress in a uniform manner and retain a seal with wall 42 of well bore 14 when annulus 72 is pressurized. Rupture disks, shear pins, and/or explosive bolts as described previously optionally may be used with the pneumatic embodiment of FIG. 13 and FIG. 14, thereby providing a means for applying an impulse force, if so desired.

Figure 15:
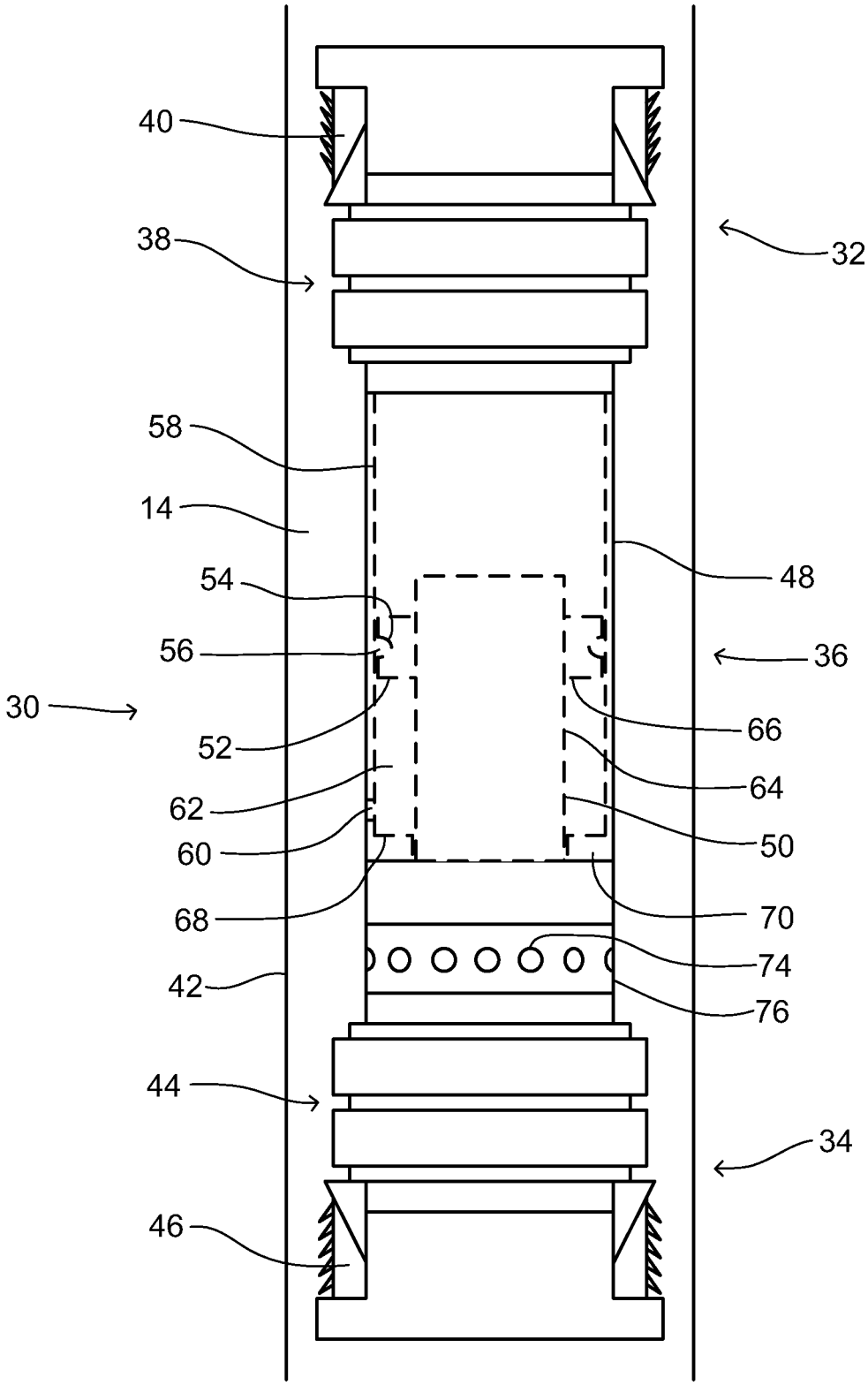
FIG. 15 is a schematic illustration of a bottom hole assembly according to an embodiment of the disclosure.

FIG. 15 illustrates an embodiment of a bottom hole assembly 30, which includes, in addition to the upper component 32, the lower component 34 and the telescoping assembly 36, a hydraulic fracture testing sub-assembly 76. The hydraulic fracture testing sub-assembly 76 may include a plurality of ports 74, via which fluid may be pumped into an annulus bounded by the sealing elements 38 and 44, the wall 42 of the well bore 14, and the telescoping assembly 36 and the hydraulic fracture testing sub-assembly 76, in order to pressurize the annulus. In addition, fluid may be ejected through the ports 74 at high pressures to produce fractures in the wall 42 of the well bore 14. Furthermore, although only shown in FIG. 15 of bottom hole assembly 30, the hydraulic fracture testing sub-assembly 76 may be included in any of the embodiments shown in FIG. 2 through FIG. 14.

Figure 16:
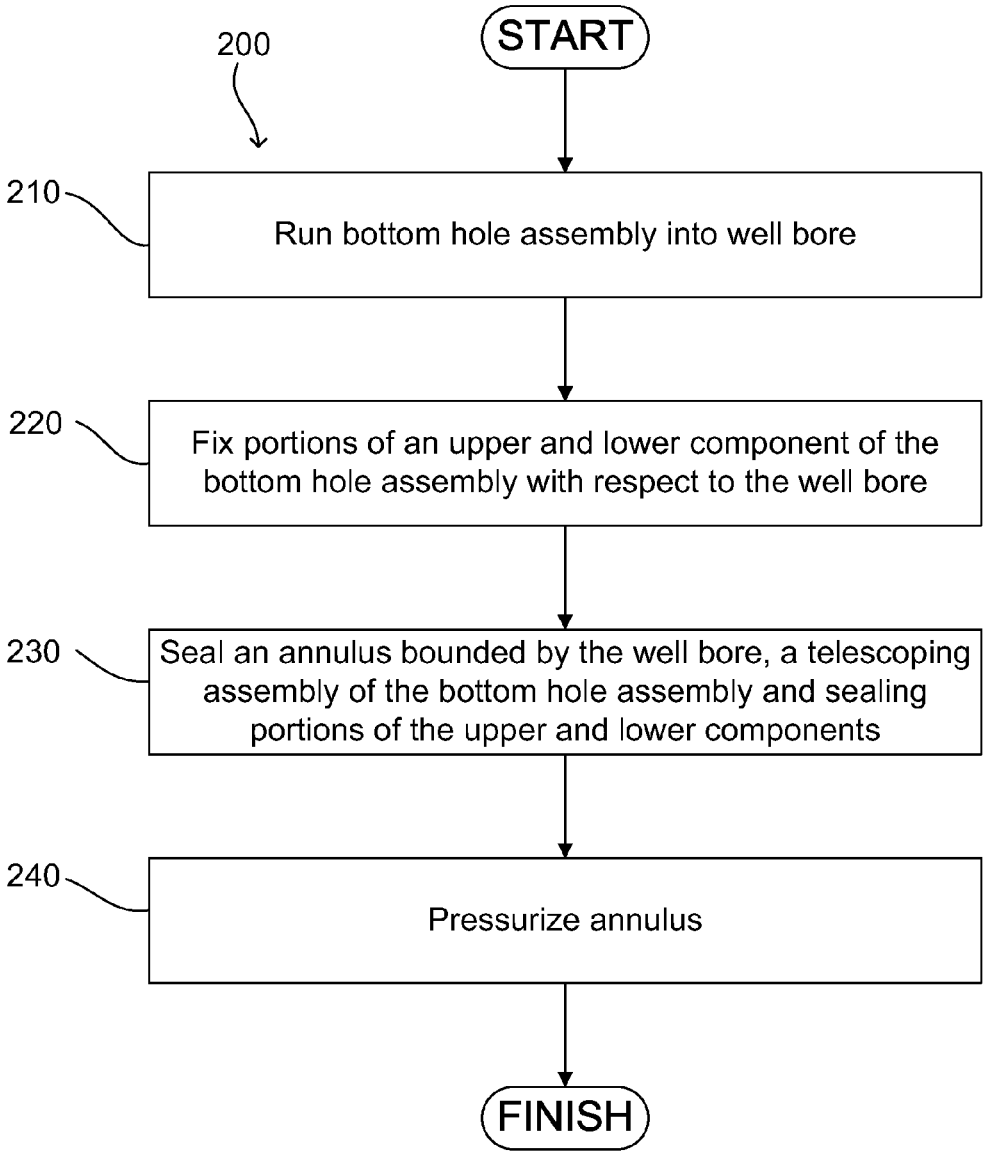
FIG. 16 is a flow chart of a method according to an embodiment of the disclosure.

Turning now to FIG. 16, a method 200 for servicing a well bore is described. At block 210, the bottom hole assembly 30 is run into the well bore 14. At block 220, a portion of the upper component 32 and a portion of the lower component 34 of the bottom hole assembly 30 may be fixed in position with respect to the well bore 14. As illustrated in FIG. 3, for example, this step may be accomplished by actuating slips 40 and 46 so as to contact and grip the wall 42 of well bore 14. At block 230, the annulus 72 bounded by the well bore 14, the telescoping assembly 36 of the bottom hole assembly 30 and sealing portions of the upper and lower components 32 and 34, e.g., sealing elements 38 and 44, is sealed. As illustrated in FIG. 3, for example, this step may be executed by applying a force or set weight to the bottom hole assembly 30 via the conveyance 20 so as to expand and force the sealing elements 38 and 44 into contact with the wall 42 of the well bore 14. At block 240, the annulus 72 is pressurized, for example, by pumping $N_2$ or another suitable fluid into the annulus 72. As the annulus 72 is pressurized, the housing 48 and the inner mandrel 50 of the telescoping assembly 36 may move relative to each other, in order to allow the sealing elements 38 and 44 to compress in a uniform manner while maintaining a seal with the wall 42.

Figure 17:
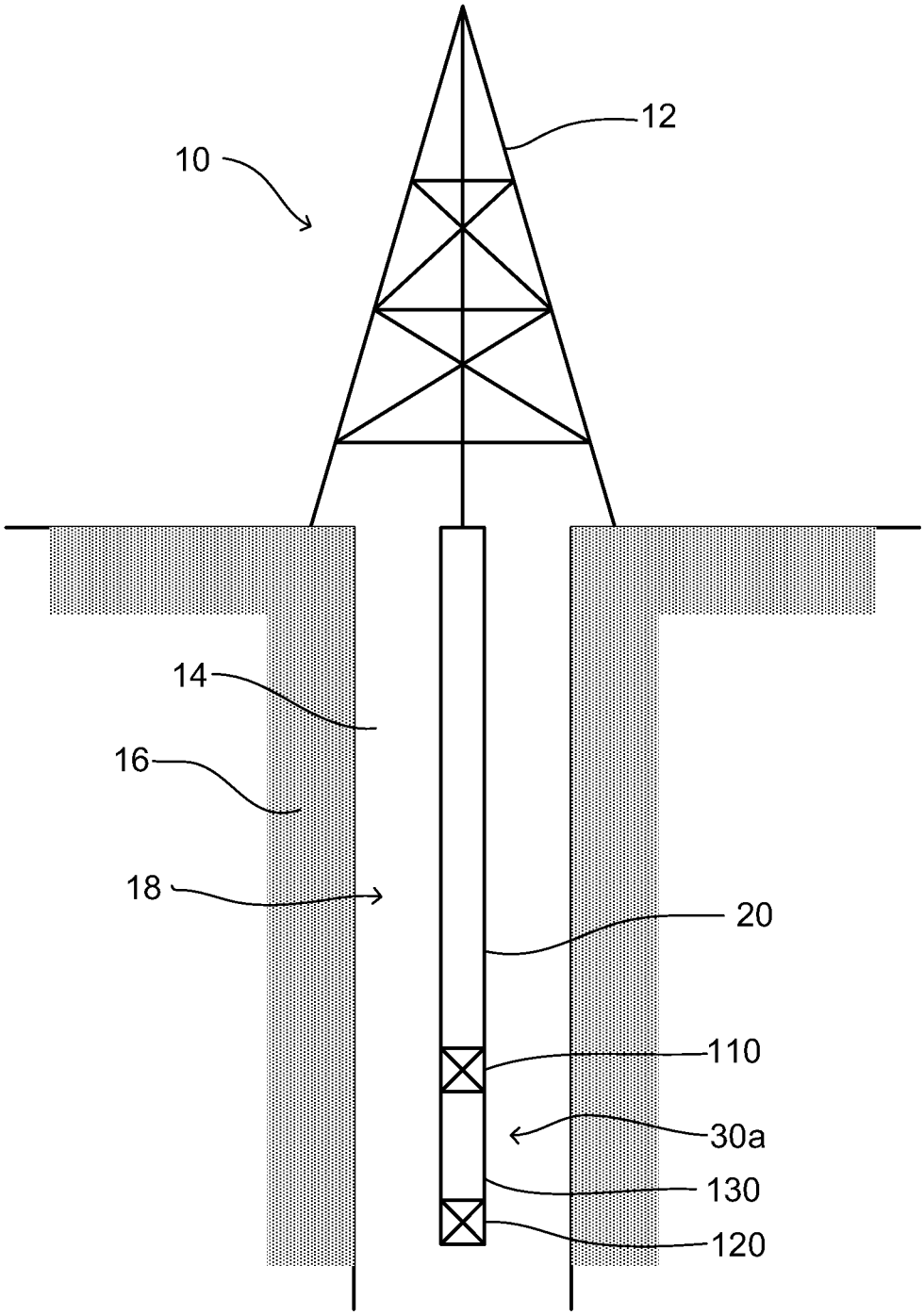
FIG. 17 is a schematic illustration of a well bore, a method of conveyance, and a bottom hole assembly according to an embodiment of the disclosure.

Turning now to FIG. 17, a wellbore servicing system 10 substantially analogous to that in FIG. 1 is disclosed. In an embodiment, the wellbore servicing system 10 may include a bottom hole assembly 30*a*, which may comprise an upper assembly 110, a lower assembly 120, and a telescoping assembly 130 situated between the upper and lower assemblies 130. In an embodiment, the bottom hole assembly 30*a* may be used to activate a system downhole from the bottom hole assembly 30*a* for a specific purpose.

In an embodiment, as the pressure in the annulus 72 is increased, the sealing element 44 compresses further and applies a downward force to inner mandrel 50. If the inner mandrel 50 and the housing 48 were rigidly connected to one another, the above-mentioned downward force would be transmitted to the lower shoe 78, thereby causing the lower shoe to pull away from sealing element 38 and increasing a probability of the sealing element becoming unseated. However, since the inner mandrel 50 and the housing 48 may move relative to one another in response to the above-mentioned downward force, the force is not applied to the lower shoe 78 and the lower shoe may remain attached to the sealing element 38. In an embodiment, O-ring 56 may be emitted, since a frictional force between the O-ring 56 and the inner wall 58 may resist the relative movement of inner mandrel 50 and housing 48 and be transmitted to lower shoe 78. In a further embodiment, to more effectively hold the sealing element 38 in place, a ratchet system could be employed to fix the lower shoe 78 in position with respect to the sealing element 38. In further embodiments, the spring 82 and the hydraulic cylinder 90 apply a further force to promote the relative movement of the inner mandrel 50 and the housing 48.

While embodiments of the invention have been shown and described, modifications thereof can be made by one skilled in the art without departing from the spirit and teachings of the invention. For example, instead of a telescoping assembly being a separate component of a bottom hole assembly, telescoping members could be integrated directly into the upper and/or lower components or the sealing elements thereof. In addition, multiple telescoping assemblies could be incorporated into a single bottom hole assembly. In the latter case, the bottom hole assembly could, for example, be run into a well bore with the telescoping assemblies collapsed, and when in position in the well bore, the telescoping assemblies could be deployed to produce a longer downhole tool than a given lubricator could normally accommodate without the telescoping feature.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What we claim as our invention is:

1. A bottom hole assembly, comprising:
an upper component;
a lower component; and
a telescoping assembly disposed between the upper component and the lower component,
wherein the upper component and the lower component comprise respective sealing elements; and
further comprising upper slips and lower slips adapted to fixedly attach the upper and lower components, respectively, to a wall of a bore hole.

2. The bottom hole assembly of claim 1, wherein the upper component, the lower component and the telescoping assembly form a straddle system.

3. The bottom hole assembly of claim 1, wherein the telescoping assembly comprises a housing and an inner mandrel movably disposed in the housing.

4. The bottom hole assembly of claim 3, wherein the telescoping assembly comprises an O-ring situated between, and in physical contact with, the housing and the inner mandrel.

5. The bottom hole assembly of claim 3, wherein the housing comprises a pressure-equalization aperture.

6. The bottom hole assembly of claim 1, wherein the telescoping assembly further comprises a force-generating element comprising a spring.

7. A bottom hole assembly, comprising:
an upper component;
a lower component; and
a telescoping assembly disposed between the upper component and the lower component, wherein the upper component and the lower component comprise respective sealing elements; and
further comprising a hydraulic fracture testing subassembly.

8. A bottom hole assembly, comprising:
an upper component;
a lower component; and
a telescoping assembly disposed between the upper component and the lower component, the telescoping assembly comprising at least two telescoping members and a force-generating element adapted to apply forces to the telescoping members,
wherein the upper component and the lower component comprise respective sealing elements, wherein the force-generating element comprises a hydraulic cylinder, and wherein the hydraulic cylinder comprises a rupture disk.

9. A bottom hole assembly, comprising:

an upper component a lower component; and a telescoping assembly disposed between the upper component and the lower component, the telescoping assembly comprising at least two telescoping members and a force-generating element adapted to apply forces to the telescoping members, wherein the upper component and the lower component comprise respective sealing elements, and wherein the force-generating element comprises a pneumatic cylinder.

10. A bottom hole assembly, comprising:

an upper component;

a lower component; and a telescoping assembly disposed between the upper component and the lower component, the telescoping assembly comprising at least two telescoping members and a force-generating element adapted to apply forces to the telescoping members, wherein the upper component and the lower component comprise respective sealing elements, and further comprising a shear pin adapted to fix the telescoping members in position with respect to one another.

11. A bottom hole assembly, comprising:

an upper component;

a lower component; and a telescoping assembly disposed between the upper component and the lower component, the telescoping assembly comprising at least two telescoping members and a force-generating element adapted to apply forces to the telescoping members, wherein the upper component and the lower component comprise respective sealing elements, and further comprising a pyrotechnic actuator adapted to fix the telescoping members in position with respect to one another.

12. A method for servicing a well bore, comprising:

running into the well bore a bottom hole assembly comprising an upper component, a lower component and a telescoping assembly disposed between the upper component and the lower component;

fixing an upper portion of the upper component and a lower portion of the lower component in position with respect to the well bore;

sealing an annulus bounded by the well bore, the telescoping assembly, a sealing portion of the upper component and a sealing portion of the lower component; and pressurizing the annulus.

13. The method of claim 12, wherein during the pressurizing, the telescoping members move relative to one another.

14. The method of claim 12, wherein the pressurizing is performed as part of a fracturing or fracture-testing operation.

15. The method of claim 12, wherein the bottom hole assembly further comprises a force-generating element adapted to apply forces to the telescoping assembly.

16. The method of claim 12, wherein the bottom hole assembly is run into the well bore using coiled tubing.

* * * * *